US010364550B2

(12) United States Patent
Amano et al.

(10) Patent No.: US 10,364,550 B2
(45) Date of Patent: Jul. 30, 2019

(54) HYDRAULIC DRIVE SYSTEM OF WORK MACHINE

(71) Applicant: Hitachi Construction Machinery Co., Ltd., Taito-ku, Tokyo (JP)

(72) Inventors: Hiroaki Amano, Kasumigaura (JP); Kouji Ishikawa, Kasumigaura (JP); Shinya Imura, Toride (JP); Hidekazu Moriki, Mito (JP); Ryohei Yamashita, Tsuchiura (JP); Seiji Hijikata, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 34 days.

(21) Appl. No.: 15/554,882

(22) PCT Filed: Feb. 22, 2016

(86) PCT No.: PCT/JP2016/055123
§ 371 (c)(1),
(2) Date: Aug. 31, 2017

(87) PCT Pub. No.: WO2016/194409
PCT Pub. Date: Dec. 8, 2016

(65) Prior Publication Data

US 2018/0038079 A1 Feb. 8, 2018

(30) Foreign Application Priority Data

Jun. 2, 2015 (JP) ..... 2015-112556

(51) Int. Cl.
*E02F 9/22* (2006.01)
*F15B 11/17* (2006.01)
(Continued)

(52) U.S. Cl.
CPC ..... *E02F 9/2228* (2013.01); *E02F 3/425* (2013.01); *E02F 9/2004* (2013.01);
(Continued)

(58) Field of Classification Search
CPC . E02F 3/32; E02F 3/425; E02F 9/2004; E02F 9/2075; E02F 9/2091; E02F 9/2228;
(Continued)

(56) References Cited

U.S. PATENT DOCUMENTS 5,584,227 A 12/1996 Chung
6,953,415 B2 * 10/2005 Kadota ..... B60K 6/44 180/65.225
9,574,329 B2 * 2/2017 Wu ..... E02F 9/2217

FOREIGN PATENT DOCUMENTS

EP 2 518 218 A2 10/2012
JP 3-3897 A 1/1991
(Continued)

OTHER PUBLICATIONS

International Preliminary Report on Patentability (PCT/IB/338 & PCT/IB/373) issued in PCT Application No. PCT/JP2016/055123 dated Dec. 14, 2017, including English translation of Document C2 (Japanese-language Written Opinion (PCT/ISA/237)) previously filed on Aug. 31, 2017 (10 pages).
(Continued)

*Primary Examiner* — Michael Leslie
*Assistant Examiner* — Michael Quandt
(74) *Attorney, Agent, or Firm* — Crowell & Moring LLP

(57) ABSTRACT

Disclosed is a hydraulic drive system capable of improving the fuel efficiency of a work machine by reducing the pressure loss and drag loss of a hydraulic pump. There are provided an electric motor M; a third pump P3 driven by the electric motor; a third pump hydraulic line L3 to which the delivered hydraulic fluid from the third pump is supplied; a
(Continued)

third directional control valve V4 provided in the third pump hydraulic line, switch-operated by an arm operation device 19, and controlling the flow rate of the hydraulic fluid supplied to the arm cylinder 8 from the third hydraulic pump; and a controller 18 drive-controlling the electric motor, wherein the controller drives the third pump by the electric motor when a swing/arm combined operation is detected by pilot pressure sensors S6, S7, S10, S11.

5 Claims, 9 Drawing Sheets

(51) Int. Cl.

| | |
|---|---|
| ***E02F 3/42*** | (2006.01) |
| ***E02F 9/20*** | (2006.01) |
| ***E02F 9/26*** | (2006.01) |
| ***F15B 11/16*** | (2006.01) |
| *E02F 3/32* | (2006.01) |

(52) U.S. Cl.
CPC ..... *E02F 9/2075* (2013.01); *E02F 9/2091* (2013.01); *E02F 9/2239* (2013.01); *E02F 9/2267* (2013.01); *E02F 9/2271* (2013.01); *E02F 9/2285* (2013.01); *E02F 9/2292* (2013.01); *E02F 9/2296* (2013.01); *E02F 9/26* (2013.01); *F15B 11/165* (2013.01); *F15B 11/17* (2013.01); *E02F 3/32* (2013.01); *E02F 9/268* (2013.01); *F15B 2211/20515* (2013.01); *F15B 2211/20523* (2013.01); *F15B 2211/20546* (2013.01); *F15B 2211/20576* (2013.01); *F15B 2211/275* (2013.01); *F15B 2211/31529* (2013.01); *F15B 2211/31535* (2013.01); *F15B 2211/31547* (2013.01); *F15B 2211/351* (2013.01); *F15B 2211/45* (2013.01); *F15B 2211/605* (2013.01); *F15B 2211/6309* (2013.01); *F15B 2211/6313* (2013.01); *F15B 2211/6316* (2013.01); *F15B 2211/6651* (2013.01); *F15B 2211/71* (2013.01); *F15B 2211/7135* (2013.01); *F15B 2211/7142* (2013.01); *F15B 2211/88* (2013.01)

(58) Field of Classification Search
CPC ..... E02F 9/2239; E02F 9/2267; E02F 9/2271; E02F 9/2285; E02F 9/2292; E02F 9/2296; E02F 9/26; E02F 9/268; F15B 11/165; F15B 11/17; F15B 21/14; F15B 2211/20515; F15B 2211/20523; F15B 2211/20546; F15B 2211/20576; F15B 2211/275; F15B 2211/31529; F15B 2211/31535; F15B 2211/31547; F15B 2211/351; F15B 2211/45; F15B 2211/605; F15B 2211/6309; F15B 2211/6313; F15B 2211/6316; F15B 2211/6651; F15B 2211/71; F15B 2211/7135; F15B 2211/7142; F15B 2211/88
See application file for complete search history.

(56) References Cited

FOREIGN PATENT DOCUMENTS

| | | | |
|---|---|---|---|
| JP | 8-105078 | A | 4/1996 |
| JP | 2007-327526 | A | 12/2007 |
| JP | 2008-45575 | A | 2/2008 |
| JP | 4509877 | B2 | 7/2010 |
| JP | 2013-28962 | A | 2/2013 |
| JP | 2014-1793 | A | 1/2014 |

OTHER PUBLICATIONS

International Search Report (PCT/ISA/210) issued in PCT Application No. PCT/JP2016/055123 dated May 24, 2016 with English translation (6 pages).
Japanese-language Written Opinion (PCT/ISA/237) issued in PCT Application No. PCT/JP2016/055123 dated May 24, 2016 (5 pages).
Extended European Search Report issued in counterpart European Application No. 16802848.8 dated Jan. 18, 2019 (ten pages).

* cited by examiner

FIG. 9

| | ARM CYLINDER DRIVE MODE | | | DRAG LOSS | PRESSURE LOSS | ELECTRIC POWER LOSS | FUEL EFFICIENCY |
|---|---|---|---|---|---|---|---|
| | LOAD PRESSURE | OPERATION | DRIVE SOURCE | | | | |
| M1 | LOW (LIGHT LOAD) | SINGLE | SECOND PUMP (ENGINE) | – | – | – | ○ |
| M2 | | | THIRD PUMP (ELECTRIC MOTOR) | ↑ | – | ↑ | × |
| M3 | | COMBINED | SECOND PUMP (ENGINE) | – | ↑↑↑ | – | × |
| M4 | | | THIRD PUMP (ELECTRIC MOTOR) | ↑ | – | ↑ | ○ |
| M5 | HIGH (HEAVY LOAD) | SINGLE | SECOND PUMP (ENGINE) | – | – | – | ○ |
| M6 | | | THIRD PUMP (ELECTRIC MOTOR) | ↑ | – | ↑↑↑ | × |
| M7 | | COMBINED | SECOND PUMP (ENGINE) | – | ↑ | – | ○ |
| M8 | | | THIRD PUMP (ELECTRIC MOTOR) | ↑ | – | ↑↑↑ | × |

↑: LOSS *ARROW SIZE INDICATES LOSS MAGNITUDE

HYDRAULIC DRIVE SYSTEM OF WORK MACHINE

TECHNICAL FIELD

The present invention relates to a hydraulic drive system mounted in a work machine such as a hydraulic excavator or a crane.

BACKGROUND ART

Generally in a hydraulic work machine such as a hydraulic excavator, a hydraulic pump is rotationally driven by an engine, and a hydraulic actuator such as a hydraulic cylinder is operated by a hydraulic fluid delivered from the hydraulic pump. Examples of such a hydraulic drive system mounted in a work machine are disclosed in Patent Documents 1 and 2.

In the hydraulic drive system disclosed in Patent Document 1, the hydraulic fluid delivered from one hydraulic pump is divided and supplied to a plurality of actuators, thereby allowing a combined operation.

On the other hand, the hydraulic drive system disclosed in Patent Document 2 is equipped with two engine-driven hydraulic pumps and one electric hydraulic pump, and the actuators are driven by different hydraulic pumps, whereby operational independence in a combined operation is realized.

PRIOR ART DOCUMENTS

Patent Documents

Patent Document 1: JP-1996-105078-A
Patent Document 2: Japanese Patent No. 4509877

SUMMARY OF THE INVENTION

Problem to be Solved by the Invention

In the hydraulic drive system disclosed in Patent Document 1, a plurality of actuators are driven by a single hydraulic pump, so that the drag loss generated at the time of rotational drive of the hydraulic pump is small. However, at the time of the combined operation, in which a plurality of actuators are driven, pressure loss is generated at a control restrictor dividing the delivered hydraulic fluid from the hydraulic pump.

On the other hand, in the hydraulic drive system disclosed in Patent Document 2, the actuators are driven by different hydraulic pumps, so that no pressure loss accompanying the flow division is generated at the time of the combined operation. However, at the time of a single operation, in which only a bucket configured to be driven by an electric hydraulic pump is operated, three hydraulic pumps including engine-driven hydraulic pumps are driven, resulting in a large drag loss.

The present invention has been made in view of the above problem. It is an object of the present invention to provide a hydraulic drive system capable of improving the fuel efficiency of a work machine by reducing the pressure loss and drag loss of a hydraulic pump.

Means for Solving the Problem (1) To solve the above problem, there are provided, in accordance with the present invention, an engine; first and second hydraulic pumps driven by the engine; first and second pump hydraulic lines to which a delivered hydraulic fluid from the respective first and second hydraulic pumps is supplied; at least one first actuator driven by the hydraulic fluid supplied from the first pump hydraulic line; a plurality of second actuators driven by the hydraulic fluid supplied from the second pump hydraulic line; a first directional control valve provided in the first pump hydraulic line and controlling a flow rate of the hydraulic fluid supplied to the first actuator; a plurality of second directional control valves provided in the second pump hydraulic line and each controlling the flow rate of the hydraulic fluid supplied to each of the plurality of second actuators; a plurality of operation devices operating the first actuator and the plurality of second actuators by respectively switch-operating the first directional control valve and the plurality of second directional control valves; an electric motor; a third hydraulic pump driven by the electric motor; a third pump hydraulic line to which a delivered hydraulic fluid from the third hydraulic pump is supplied; a third directional control valve provided in the third pump hydraulic line, switch-operated by a specific operation device of the plurality of operation devices that operates a specific actuator of the plurality of second actuators, and controlling the flow rate of the hydraulic fluid supplied to the specific actuator from the third hydraulic pump; and a control device drive-controlling the electric motor in accordance with an operation of the plurality of second actuators.

In the present invention configured as described above, a specific actuator can be selectively driven by the second hydraulic pump driven by the engine and the third hydraulic pump driven by the electric motor, so that the pressure loss of the second hydraulic pump and the drag loss of the third hydraulic pump are suppressed, making it possible to improve the fuel efficiency of the work machine.

(2) In the above configuration (1), there are preferably further provided a plurality of operation amount detection devices detecting operation amounts of the plurality of operation devices, and the control device drives the third hydraulic pump by the electric motor when a combined operation of two or more second actuators including the specific actuator of the plurality of second actuators is detected by the plurality of operation amount detection devices.

In this way, at the time of a combined operation of two or more second actuators including a specific actuator, the specific actuator is driven by the third hydraulic pump, and no hydraulic fluid is supplied to the specific actuator from the second hydraulic pump, so that the pressure loss of the second hydraulic pump is suppressed.

(3) In the above configuration (2), there is preferably further provided a load pressure detection device detecting a load pressure in the specific actuator, and the control device does not drive the third hydraulic pump by the electric motor when a combined operation of two or more second actuators including the specific actuator of the plurality of second actuators is detected by the plurality of operation amount detection devices, and when the load pressure of the specific actuator detected by the load pressure detection device is higher than a predetermined load pressure.

In this way, during a combined operation and heavy load work of two or more second actuators including a specific actuator, the specific actuator is driven by the engine-driven second hydraulic pump, whereby it is possible to suppress the electric power loss of the electric motor, and to maintain the same operability as that in the prior art.

(4) In the above configuration (1), the specific actuator is preferably an arm cylinder.

In this way, the arm cylinder which frequently undergoes a combined operation during light load work and which requires a great flow rate is used as a specific actuator that can be selectively driven by the engine-driven second hydraulic pump and the electric-motor-driven third hydraulic pump, whereby it is possible to enhance the effect of reducing the pressure loss of the second hydraulic pump and the drag loss of the third hydraulic pump.

(5) In the above configuration (1), there is preferably further provided an abnormality detection device detecting abnormality in an electric system including the electric motor, and the control device does not drive the third hydraulic pump by the electric motor when abnormality in the electric system is detected by the abnormality detection device.

In this way, when abnormality occurs in the electric system including the electric motor, the specific actuator is driven by the engine-driven second hydraulic pump, whereby it is possible to prevent serious failure related to the electric system, and to maintain the same operability as that in the prior art.

(6) In the above configuration (1), there are preferably further provided a battery accumulating electric power for driving the electric motor, and a charging rate detection device detecting a charging rate of the battery, wherein the control device does not drive the third hydraulic pump by the electric motor when the battery charging rate detected by the charging rate detection device is lower than a predetermined charging rate.

In this way, when there is a shortage of battery residual amount, a specific actuator is driven by the engine-driven second hydraulic pump, whereby it is possible to maintain the same operability as in the prior art.

Advantage of the Invention

In accordance with the present invention, the pressure loss or drag loss of a hydraulic pump is reduced, thereby making it possible to improve the fuel efficiency of a work machine.

BRIEF DESCRIPTION OF THE DRAWINGS

FIG. 9 is a diagram illustrating the relationship between an arm cylinder drive mode and energy loss.

MODES FOR CARRYING OUT THE INVENTION

In the following, as an embodiment of the present invention, a case will be described in which the present invention is applied to a hydraulic drive system of a hydraulic excavator.

—Configuration—

Figure 1:
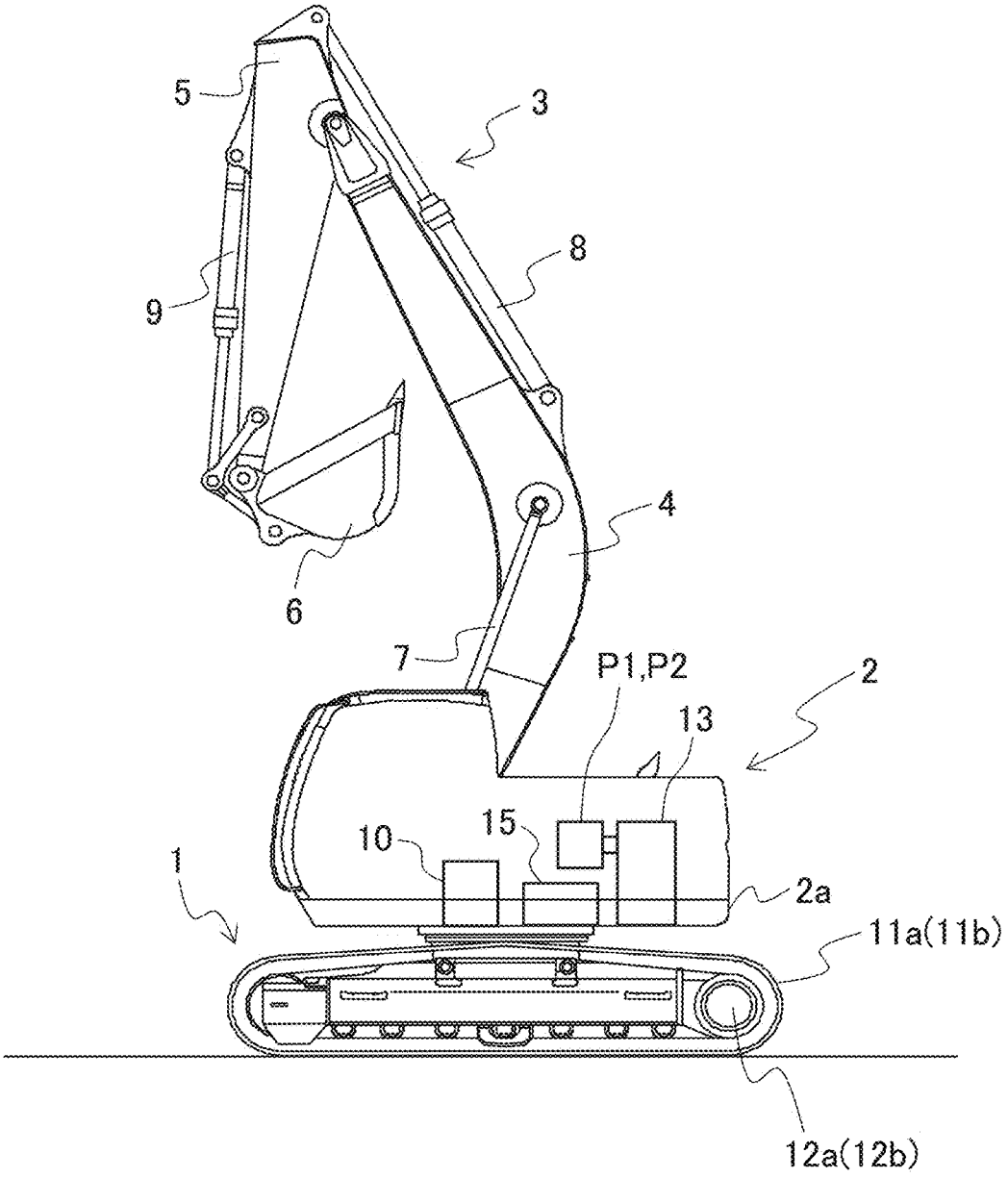
FIG. 1 is a side view of a hydraulic excavator equipped with a hydraulic drive system according to an embodiment of the present invention.

FIG. 1 is a diagram showing an outward appearance of a hydraulic excavator according to the present embodiment. The hydraulic excavator is equipped with a lower track structure 1, an upper swing structure 2, and a front work device 3.

The lower track structure 1 is equipped with left and right crawlers 11*a* and 11*b* (of which only the left-side one is shown) and left and right traveling hydraulic motors 12*a* and 12*b* (of which only the left-side one is shown), and travels by driving the left and right crawlers 11*a* and 11*b* by the left and right traveling hydraulic motors 12*a* and 12*b*.

The upper swing structure 2 has a swing frame 2*a* as a support mechanism, and mounted on the swing frame 2*a* are an engine 13 as a prime mover, an electric motor M (not shown), a generator motor GM (not shown) connected to the engine 13, hydraulic pumps P1 and P2 driven by the engine 13, a hydraulic pump P3 (not shown) driven by the electric motor, a swing hydraulic motor 10 swing-driving the upper swing structure 2 (swing frame 2*a*) with respect to the lower track structure 1, a control valve 15 distributing and supplying the delivered hydraulic fluids from the hydraulic pumps P1 through P3 to actuators 7 through 10, 12*a*, and 12*b*, etc.

The front work device 3 has a boom 4 mounted to the upper swing structure 2 so as to be vertically rotatable, an arm 5 rotatably mounted to the distal end of the boom 4, and a bucket 6 rotatably mounted to the distal end of the arm 5. The boom 4 rotates in the vertical direction through expansion and contraction of a boom cylinder 7, the arm 5 rotates in the vertical/front-rear direction through expansion and contraction of an arm cylinder 8, and the bucket 6 rotates in the vertical/front-rear direction through expansion and contraction of a bucket cylinder 9.

Figure 2:
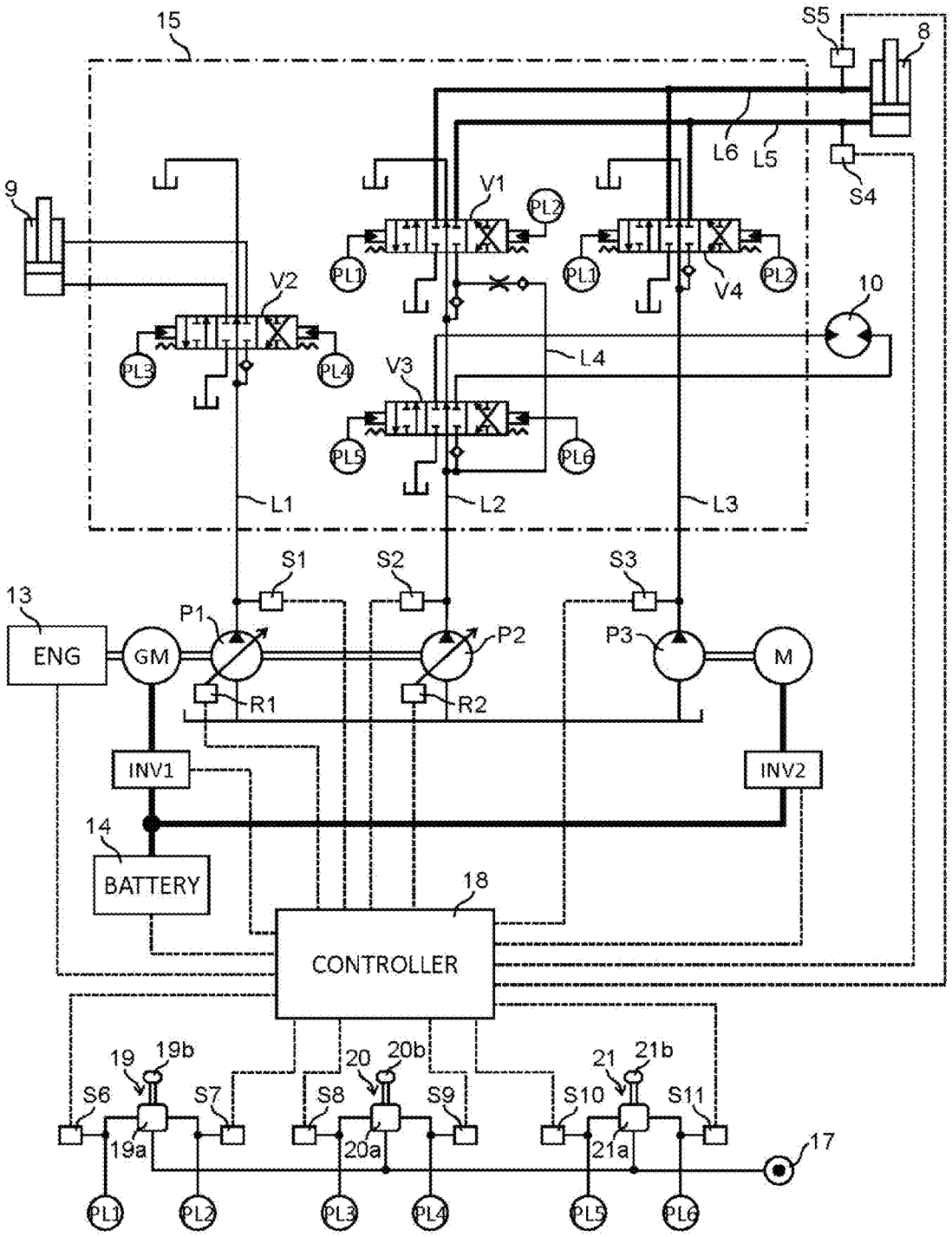
FIG. 2 is a schematic diagram illustrating a hydraulic drive system according to an embodiment of the present invention.

FIG. 2 is a schematic diagram illustrating a hydraulic drive system according to an embodiment of the present invention. The hydraulic drive system is equipped with the engine 13, the generator motor GM, the electric motor M, the three hydraulic pumps (hereinafter referred to as the first through third pumps as appropriate) P1 through P3, the control valve 15, a plurality of actuators 8 through 10, a plurality of operation devices 19 through 21 respectively operating the actuators 8 through 10, and a main controller as a control device (hereinafter referred to as the controller as appropriate) 18.

While the boom cylinder 7 of FIG. 1 and the left and right traveling hydraulic motors 12*a* and 12*b* are driven by one of the first and second pumps P1 and P2, the operation of the actuators 7, 12*a*, and 12*b* does not affect the following discussion, so that, in FIG. 2, the portions related to the driving of the actuators 7, 12*a*, and 12*b* is omitted.

The generator motor GM is connected to the output shaft of the engine 13, and the first and second pumps P1 and P2 are connected to the output shaft of the generator motor GM. The generator motor GM is operated by one of or both the drive force of the engine 13 and electrical energy accumulated in a battery 14, and drives the first and second pumps P1 and P2. The generator motor GM is connected to the battery 14 and a second inverter INV2 via a first inverter INV1, and has the function of a generator converting the power of the engine 13 to electrical energy and outputting it to the battery 14 or the second inverter INV2, and the function of an electric motor assist-driving the first and second pumps P1 and P2 by the electrical energy of the battery 14 supplied via the first inverter INV1.

The third pump P3 is connected to the output shaft of the electric motor M. The electric motor M is connected to the battery 14 and the first inverter INV1 via the second inverter INV2, and is operated by one of or both the electrical energy accumulated in the battery 14 and the electrical energy generated by the generator motor GM, driving the third pump P3.

The first and second pumps P1 and P2 are variable displacement hydraulic pumps, and are controlled in delivery flow rate through the adjustment of the pump capacities (displacement volumes) via first and second pump regulators R1 and R2, respectively. The third pump P3 is a fixed displacement hydraulic pump, and is controlled in delivery flow rate through the adjustment of the motor speed of the electric motor M via the second inverter INV2.

The control valve 15 is arranged between the first through third pumps P1 through P3 and the plurality of actuators 8 through 10, and distributes and supplies the delivered hydraulic fluids from the first through third pumps P1 through P3 to the actuators 8 through 10. Inside the control valve 15, there are formed a plurality of pump hydraulic lines (hereinafter referred to as the first through third pump hydraulic lines as appropriate) L1 through L3. In the first pump hydraulic line L1, there is arranged a directional control valve V2 controlling the direction and flow rate of the hydraulic fluid supplied to the bucket cylinder 9. In the second pump hydraulic line L2, there are arranged a directional control valve V1 controlling the direction and flow rate of the hydraulic fluid supplied to the arm cylinder 8 and a directional control valve V3 controlling the direction and flow rate of the hydraulic fluid supplied to a swing hydraulic motor 10. In the third pump hydraulic line L3, there is arranged a directional control valve V4 controlling the direction and flow rate of the hydraulic fluid supplied to the arm cylinder 8. The delivered hydraulic fluids from the first through third hydraulic pumps P1 through P3 are guided to the first through third pump hydraulic lines L1 through L3, respectively, and are supplied to the actuators 8 through 10 via the directional control valves V1 through V4.

Pump pressure sensors S1 through S3 detecting the delivery pressures of the first through third pumps P1 through P3 are respectively mounted to the first through third pump hydraulic lines L1 through L3, and load pressure sensors S4 and S5 detecting the load pressure in the arm cylinder 8 are respectively mounted to a head side hydraulic line L5 and a rod side hydraulic line L6 connecting the arm cylinder 8 and the directional control valves V1 and V4. The detection signals of the pump pressure sensors S1 through S3 and of the load pressure sensors S4 and S5 are inputted to the controller 18.

The operation device (hereinafter referred to as the arm operation device as appropriate) 19 is equipped with a pilot valve 19*a*, and an operation lever 19*b* (hereinafter referred to as the arm operation lever as appropriate) connected to the pilot valve 19*a*. The pilot valve 19*a* is connected to a pilot hydraulic fluid source 17 formed by a pilot pump, a pilot relief valve, etc., and reduces a pilot primary pressure inputted from the pilot hydraulic fluid source 17 in accordance with the operational direction and operation amount of the operation lever 19*b*, outputting it as pilot pressures PL1 and PL2. The pilot pressures PL1 and PL2 are respectively guided to left pilot pressure receiving portions of the directional control valves V1 and V4 for the arm operation and to right pilot pressure receiving portions of the directional control valves V1 and V4 to switch-operate the directional control valves V1 and V4 to one of the right and left sides. Pilot pressure sensors S6 and S7 detecting the pilot pressures PL1 and PL2 are each mounted to the two pilot hydraulic lines connected to the pilot valve 19*a*, and the detection signals of the pilot pressure sensors S6 and S7 are inputted to the controller 18.

The operation device 20 (hereinafter referred to as the bucket operation device as appropriate) is equipped with a pilot valve 20*a*, and an operation lever (hereinafter referred to as the bucket operation lever as appropriate) 20*b* connected to the pilot valve 20*a*. The pilot valve 20*a* is connected to the pilot hydraulic fluid source 17, and reduces the pilot primary pressure inputted from the pilot hydraulic fluid source 17 in accordance with the operational direction and operation amount of the operation lever 20*b*, outputting it as pilot pressures PL3 and PL4. The pilot pressures PL3 and PL4 are respectively guided to a left pressure receiving portion and to a right pilot pressure receiving portion of the directional control valve V2 for the bucket operation to switch-operate the directional control valve V2 to one of the right and left sides. Pilot pressure sensors S8 and S9 detecting the pilot pressures PL3 and PL4 are each mounted to the two pilot hydraulic lines connected to the pilot valve 20*a*, and the detection signals of the pilot pressure sensors S8 and S9 are inputted to the controller 18.

The operation device 21 (hereinafter referred to as the swing operation device as appropriate) is equipped with a pilot valve 21*a*, and an operation lever connected to the pilot valve 21*a* (hereinafter referred to as the swing operation lever as appropriate) 21*b*. The pilot valve 21*a* is connected to the pilot hydraulic fluid source 17, and reduces the pilot primary pressure inputted from the pilot hydraulic fluid source 17 in accordance with the operational direction and operation amount of the operation lever 21*b*, outputting it as pilot pressures PL5 and PL6. The pilot pressures PL5 and PL6 are respectively guided to a left pilot pressure receiving portion and to a right pilot pressure receiving portion of the directional control valve V3 for the swing operation to switch-operate the directional control valve V3 to one of the right and left sides. Pilot pressure sensors S10 and S11 detecting the pilot pressures PL5 and PL6 are each mounted to the two pilot hydraulic lines connected to the pilot valve 21*a*, and the detection signals of the pilot pressure sensors S10 and S11 are inputted to the controller 18.

The controller 18 monitors the detection values of the pump pressure sensors S1 through S3 (the delivery pressures of the first through third pumps P1 through P3) such that the first through third pumps P1 through P3 do not exceed a limited value, and sets the target flow rates of the first through third pumps P1 through P3 in accordance with the detection values of the pump pressure sensors S1 to S3 (the delivery pressures of the first through third pumps P1 through P3), the detection values of the load pressure sensors S4 and S5 (the arm load pressure) and the detection values of the pilot pressure sensors S6 through S11 (the pilot pressures P1 through P6), controlling the capacities (displacement volumes) of the first and second pumps P1 and P2 and the motor speed of the electric motor M such that the delivery flow rates of the first through third pumps P1 through P3 coincide with the respective target flow rates. The pump capacities (displacement volumes) of the first and second pumps P1 and P2 are controlled through the transmission of tilting control signals to the first and second pump regulators R1 and R2 by the controller 18, and the motor speed of the electric motor M is controlled through the transmission of an motor speed control signal to the second inverter INV2 by the controller 18.

—Control—

A method of controlling the hydraulic drive system according to the present embodiment will be described with reference to FIG. 3.

Figure 3:
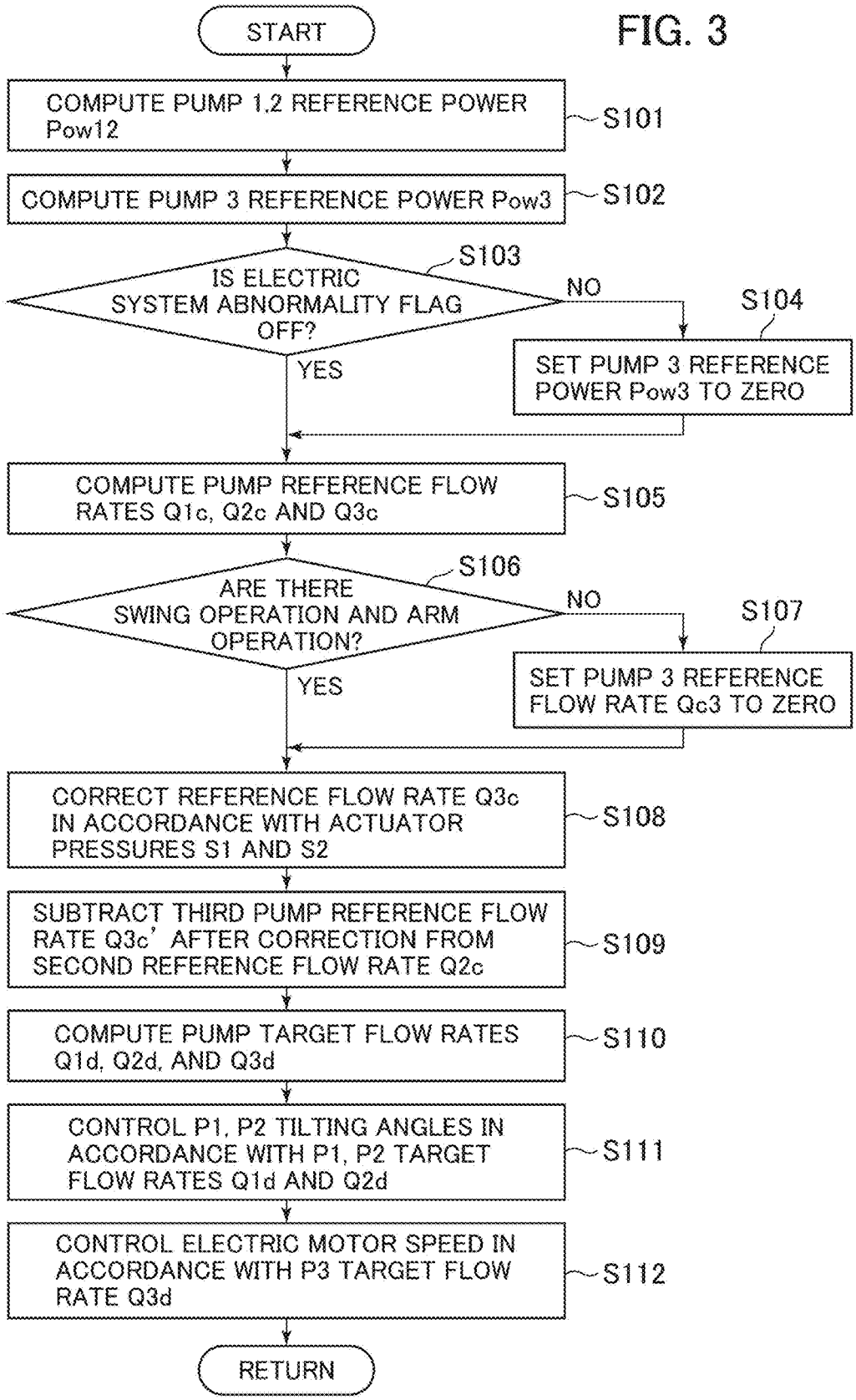
FIG. 3 is a flowchart illustrating the control by a main controller according to an embodiment of the present invention.

FIG. 3 is a flowchart illustrating the control by the controller 18. The steps constituting the control flow of FIG. 3 will be sequentially described below.

Figure 4A:
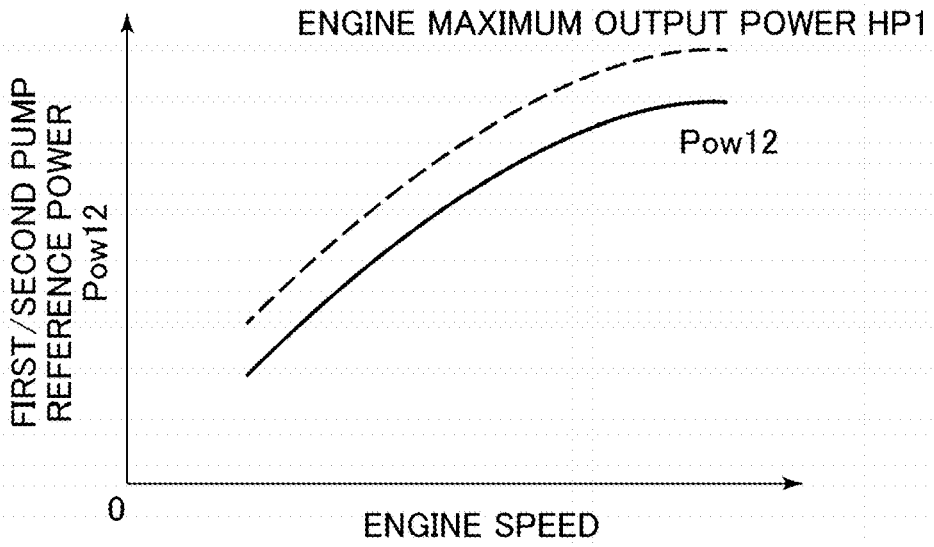
FIG. 4A is a chart illustrating the relationship between an engine speed and a reference power of first and second pumps in an embodiment of the present invention.

In step S101, referring to a pre-set table (an example of which is shown in FIG. 4A), a first/second pump reference power Pow12 is determined from the current engine speed or the engine speed target value. It is noted here that the table is set such that the first/second pump reference power Pow12 does not exceed the maximum engine output power HP1.

Figure 4B:
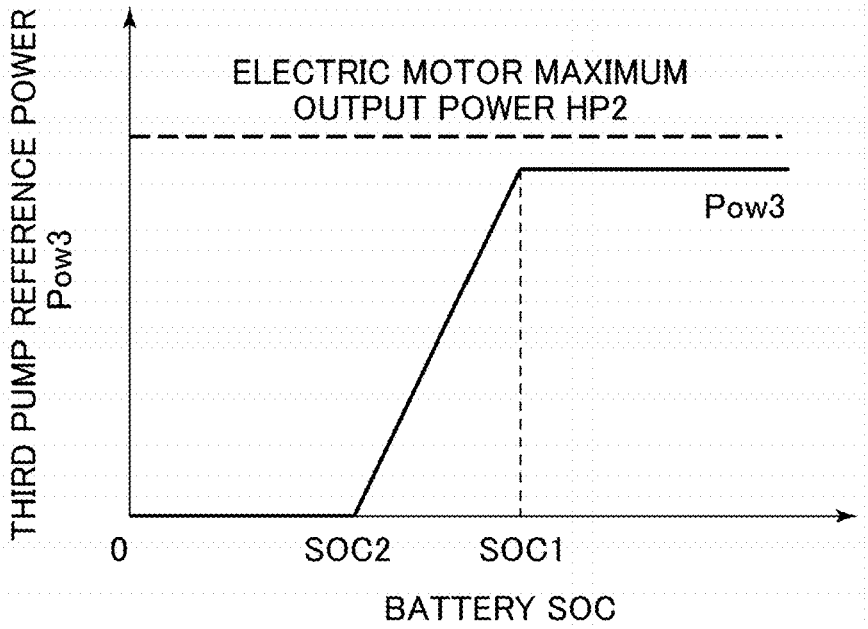
FIG. 4B is a chart illustrating the relationship between a battery SOC and a reference power of a third pump in an embodiment of the present invention.

In step S102, referring to a pre-set table (an example of which is shown in FIG. 4B), a third pump reference power Pow3 is determined from the battery charging amount (SOC). It is noted here that the table is set such that the third pump reference power Pow3 does not exceed the maximum output power HP2 of the electric motor M and that when the battery residual amount becomes less than a predetermined battery residual amount (SOC2), the third pump reference power is reduced to zero.

In step S103, it is determined whether or not an electric system abnormality flag is OFF. When the electric system abnormality flag is OFF, the controller 18 advances to step S105. When the electric system abnormality flag is ON, the controller 18 advances to step S104, in which the third pump reference power Pow3 is set to zero, and then advances to step S105.

Figure 5:
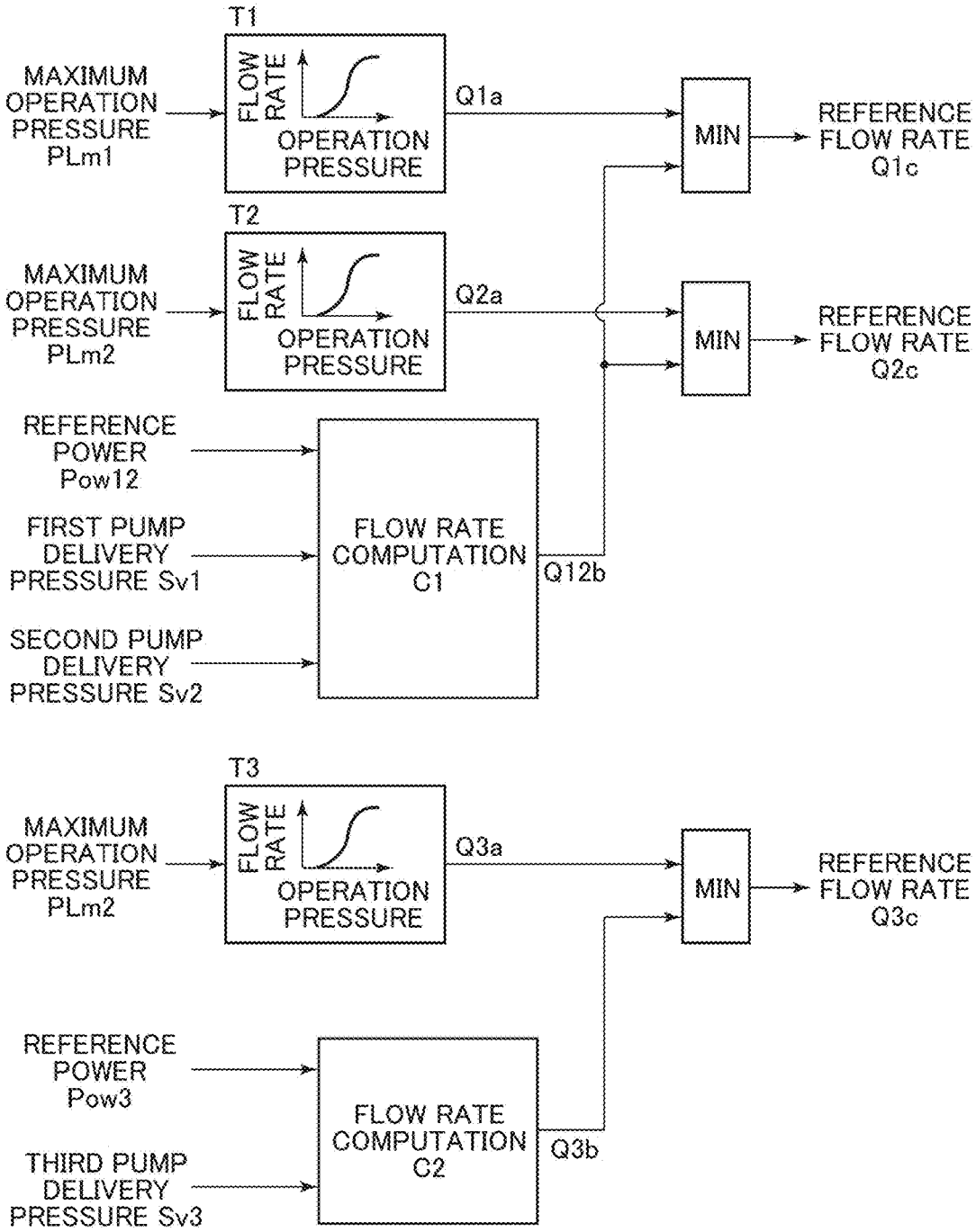
FIG. 5 is a computation flowchart of a pump reference flow rate according to an embodiment of the present invention.

In step S105, based on the computation flow shown in FIG. 5, the reference flow rates Q1*c*, Q2*c*, and Q3*c* of each pump are determined from various operation signals, first through third pump delivery pressures (the detection values of the pump pressure sensors S1 through S3) Sv1 through Sv3, and the pump reference powers Pow12 and Pow3.

In the computation flow of FIG. 5, a flow for computing the reference flow rates of the first and second pumps P1 and P2 will be first described.

First, referring to a table T1, and the flow rate Q1*a* is determined from the maximum operation pilot pressure value PLm1 of the actuators connected to the first pump P1. Similarly, referring to a table T2, and the flow rate Q2*a* is determined from the maximum operation pilot pressure value PLm2 of the actuators connected to the second pump P2.

Next, a flow rate Q12*b* is calculated in accordance with the following equations from the first and second pump delivery pressures Sv1 and Sv2 and the first/second pump reference power Pow12 (flow rate computation C1).

$$P12=(Sv1+Sv2)/2$$

$$Q12b=\mathrm{Pow}12b/P12\times 60$$

Finally, the minimum value of Q1*a* and Q12*b* is set as the first pump reference flow rate Q1*c*, and the minimum value of Q2*a* and Q12*b* is set as the second pump reference flow rate Q2*c*.

Next, with reference to the computation flow of FIG. 5, the computation flow for the reference flow rate of the third pump P3 will be described.

First, referring to a table T3, the flow rate Q3*a* is determined from the maximum value PLm3 of the operation pilot pressure of the actuators connected to the third pump P3.

Next, the flow rate Q3*b* is calculated in accordance with the following equation from the third pump delivery pressure Sv3 and the third pump reference power Pow3 (flow rate computation C2).

$$Q3b=\mathrm{Pow}3b/Sv2\times 60$$

Finally, the minimum value of Q3*a* and Q3*b* is set as the third pump reference flow rate Q3*c*. It is noted here that particularly when the third pump reference power Pow3 is reduced to zero in steps S102 and S104, the third pump reference flow rate Q3*c* is reduced to zero.

In step S106, it is determined from the operation pilot pressure sensor values whether or not the arm operation and the swing operation are being simultaneously performed. When they are being performed simultaneously, the controller 18 advances to step S108. When they are not being performed simultaneously, the controller 18 advances to step S107, in which the third pump reference flow rate Q3*c* is set to zero.

Figure 6:
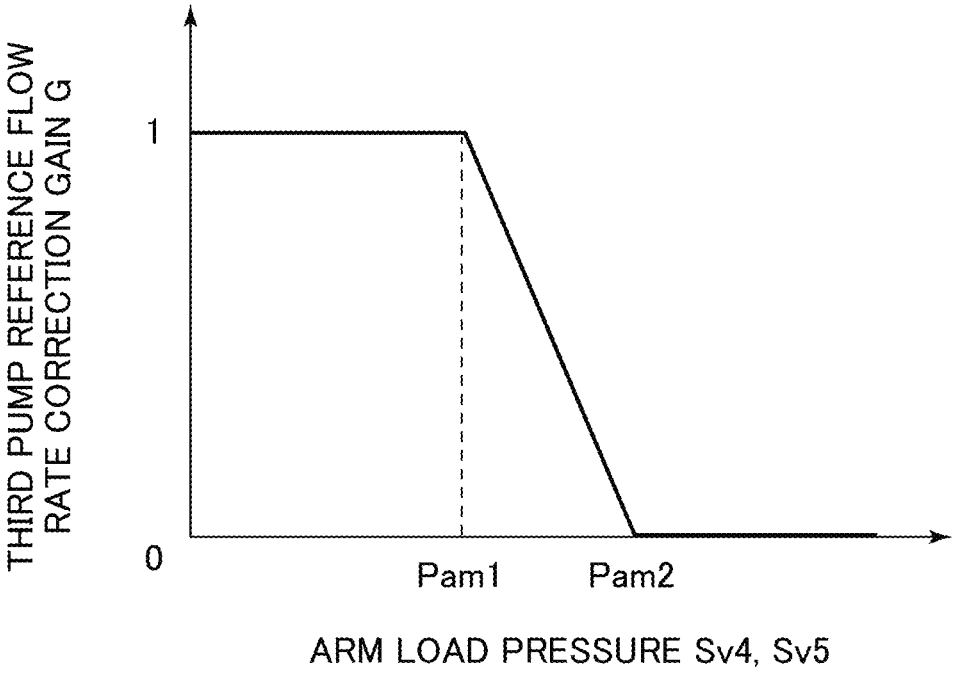
FIG. 6 is a chart illustrating the relationship between an arm load pressure and a third pump reference flow rate correction gain in an embodiment of the present invention.

In step S108, referring to a pre-set table (an example of which is shown in FIG. 6), a correction gain G is determined from the detection values Sv4 and Sv5 of the load pressure sensors S4 and S5, and the third pump reference flow rate is corrected by the following equation.

$$Q3c'=Q3c\times G$$

It is noted here that the value of G ranges from 0 to 1 and takes a value of 0 when the actuator load pressure is of a certain fixed value (Pam2 in FIG. 6) or more.

In step S109, the corrected third pump reference flow rate Q3*c*' is subtracted from the second pump reference flow rate, and the corrected second pump reference flow rate Q2*c*' is computed.

$$Q2c'=Q2c-Q3c'$$

In step S110, the first through third pump target flow rates Q1*d*, Q2*d*, and Q3*d* are determined. It is noted here that the first pump target flow rate Q1*d* is set to Q1*c*, the second pump target flow rate Q2*d* is set to the corrected second pump reference flow rate Q2*c*', and the third pump target flow rate Q3*d* is set to the corrected third pump reference flow rate Q3*c*'.

In step S111, the first and second pump target displacement volumes are computed from the first and second pump target flow rates Q1*d* and Q2*d* and the current engine speed or the target engine speed, and tilting commands are transmitted to the first and second pump regulators R1 and R2.

In step S112, the electric motor target motor speed is computed from the third pump target flow rate Q3*d* and the third pump displacement volume, and an electric motor speed command is transmitted to the second inverter INV2 to control the electric motor speed, and the flow is completed.

Next, a battery charging rate obtaining method and an electric system abnormality flag setting method by the main controller 18 will be described with reference to FIGS. 7 and 8.

Figure 7:
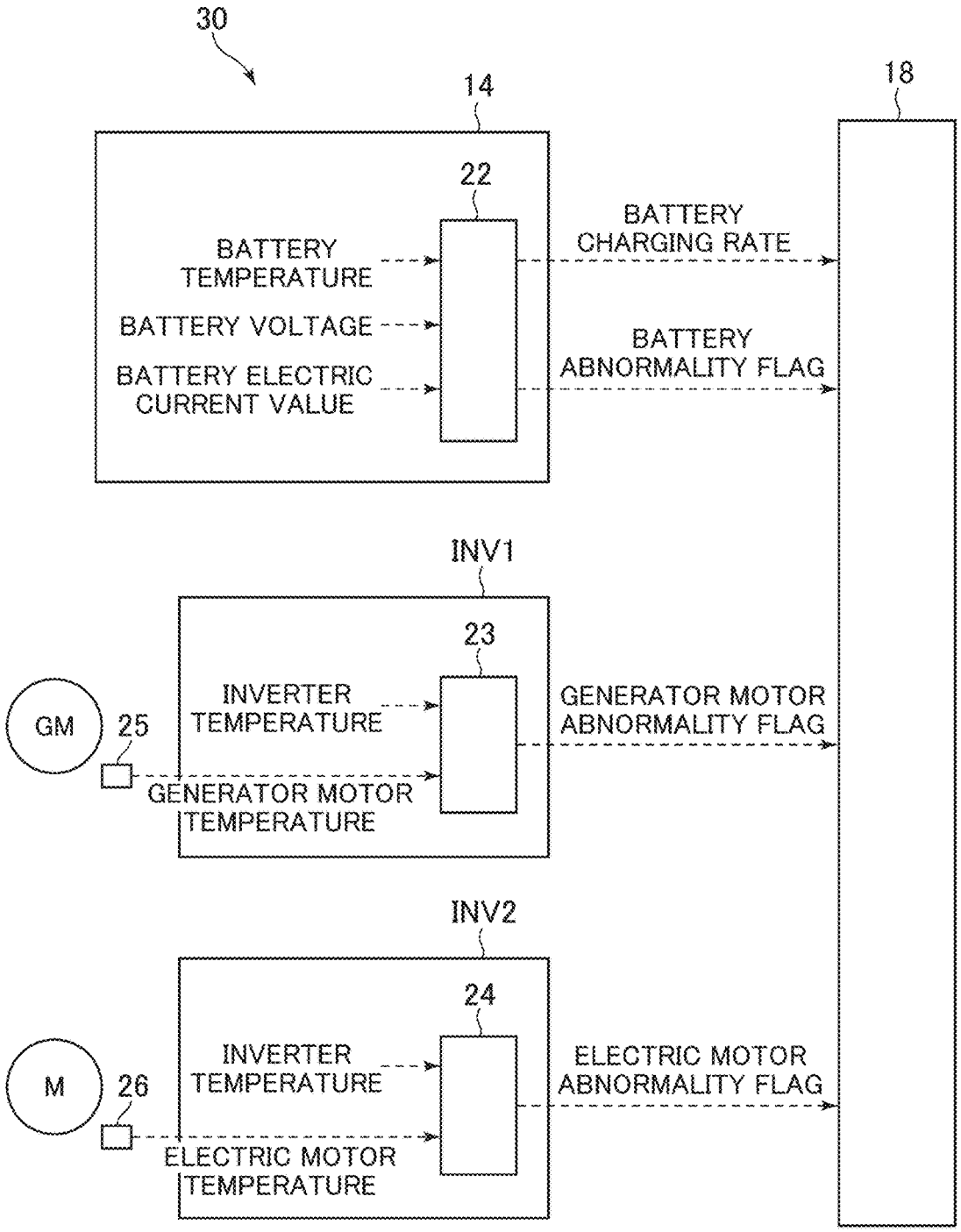
FIG. 7 is a block diagram illustrating a data flow from an electric system to the main controller in an embodiment of the present invention.

FIG. 7 is a block diagram illustrating a data flow from an electric system 30 to the main controller 18. The electric system 30 is configured with devices related to the driving of the third pump P3, such as the battery 14, the generator motor GM, the electric motor M, the first inverter INV1, and the second inverter INV2. A battery controller 22 mounted on the battery 14 calculates the battery charging rate based on the battery temperature, the battery voltage, and the battery electric current value, and transmits it to the main controller 18. Further, the battery controller 22 sets a battery abnormality flag to OFF or ON based on the battery temperature, and transmits it to the main controller 18. It is noted here that when the battery temperature is within its normal temperature range, the battery abnormality flag is set to OFF, and when the battery temperature deviates from its normal temperature range, it is set to ON.

The first inverter controller 23 mounted in the first inverter INV1 sets a generator motor abnormality flag to OFF or ON based on the inverter temperature and the generator motor temperature received from a generator motor thermistor 25 mounted to the generator motor GM, and transmits it to the main controller 18. It is noted here that when the inverter temperature and the generator motor temperature are each within its normal temperature range, the generator motor abnormality flag is set to OFF, and when the inverter temperature or the generator motor temperature deviates from its normal temperature range, it is set to ON.

The second inverter controller 24 mounted in the second inverter INV2 sets an electric motor abnormality flag to OFF or ON based on the inverter temperature and the electric motor temperature received from an electric motor thermistor 26 mounted to the electric motor M, and transmits it to the main controller 18. It is noted here that when the inverter temperature and the electric motor temperature are each within its normal temperature range, the electric motor abnormality flag is set to OFF, and when the inverter temperature or the electric motor temperature deviates from its normal temperature range, it is set to ON.

Figure 8:
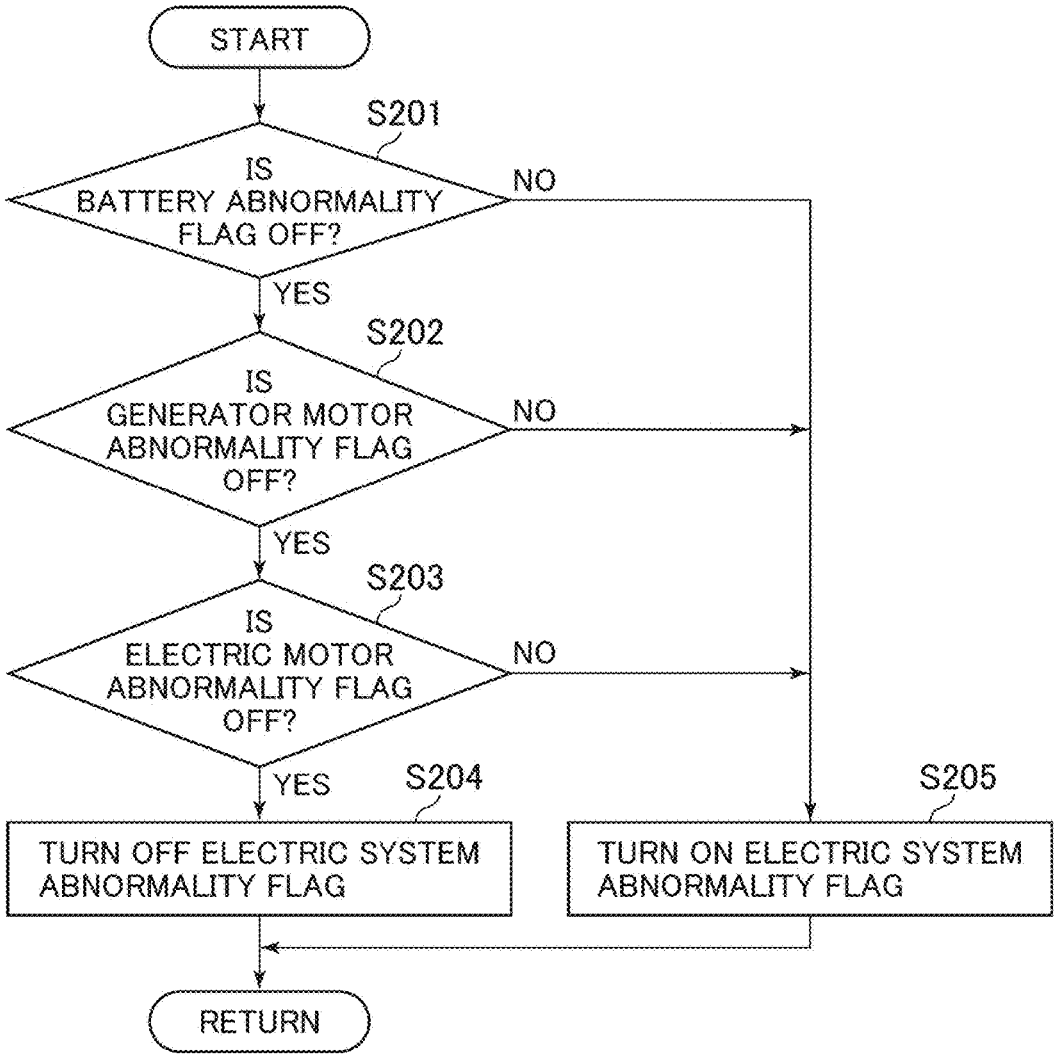
FIG. 8 is a flowchart illustrating an electric system abnormality flag setting processing by the main controller according to an embodiment of the present invention.

FIG. 8 is a flowchart illustrating electric system abnormality flag setting processing by the main controller 18. The steps constituting the flow of FIG. 8 will be sequentially described below.

First, the main controller 18 determines whether or not the battery abnormality flag received from the battery controller 22 is OFF (step S201).

When the determination in step S201 is YES (the battery abnormality flag is OFF), it is determined whether or not the generator motor abnormality flag received from the first inverter controller 23 is OFF (step S202).

When the determination in step S202 is YES (the battery abnormality flag is OFF), it is determined whether or not the electric motor abnormality flag received from the second inverter controller 24 is OFF (step S203).

When the determination in step S203 is YES (the electric motor abnormality flag is OFF), the electric motor abnormality flag is set to OFF (step S204), and the flow is completed.

On the other hand, when the determination in one of steps S201 through S203 is NO, the electric system abnormality flag is set to ON (step S205), and the flow is completed.

Through the above flow, when all the apparatuses constituting the electric system 30 are normal, the electric system abnormality flag is set to OFF, and when abnormality occurs in one of the apparatuses constituting the electric system 30, the electric system abnormality flag is set to ON.

—Operation—

The operation of the hydraulic drive system realized by the above-described control flow of the controller 18 will be described with reference to FIG. 2.

(Arm/Bucket Combined Operation)

When the arm operation lever 19*b* and the bucket operation lever 20*b* are simultaneously operated, the pilot pressures PL1 and PL2 and the pilot pressures PL3 and PL4 are respectively outputted from the pilot valves 19*a* and 20*a* in accordance with the operational direction and operation amount of each lever.

The controller 18 sets the target flow rates of the first and second pumps P1 and P2 in accordance with the delivery pressures of the first and second pumps P1 and P2 (the detection values of the pump pressure sensors S1 and S2), and controls the tilting angles of the first and second pumps P1 and P2 such that the delivery flow rates of the first and second pumps P1 and P2 each coincide with their target flow rates. Further, since this is not a swing/arm combined operation, the target flow rate of the third pump P3 is set to zero, and the electric motor M is not operated.

The arm pilot pressures PL1 and PL2 outputted from the arm operation device 19 switch-operate the directional control valves V1 and V4 to the left or right. The bucket pilot pressures PL3 and PL4 outputted from the bucket operation device 20 switch-operate the directional control valve V2 to the left or right.

As a result, in accordance with the operation of the arm operation lever 19*b*, the hydraulic fluid is supplied to the arm cylinder 8 from the second pump hydraulic line L2, and, in accordance with the operation of the bucket operation lever 20*b*, the hydraulic fluid is supplied to the bucket cylinder 9 from the first pump hydraulic line L1, thus realizing the arm/bucket combined operation. At this time, the electric motor M is not operated, so that no hydraulic fluid is supplied to the arm cylinder 8 from the third hydraulic pump P3.

(Arm/Bucket/Swing Combined Operation (Light Load))

When the arm operation lever 19*b*, the bucket operation lever 20*b*, and the swing operation lever 21*b* are simultaneously operated, the pilot pressures PL1 and PL2, the pilot pressures PL3 and PL4, and the pilot pressures PL5 and PL6 are respectively outputted from the pilot valves 19*a* through 21*a* in accordance with the operational direction and operation amount of each lever.

The controller 18 controls the delivery flow rates of the first through third pumps P1 through P3 based on the control flow of FIG. 3. First, Pow12 is determined from the engine speed, and Pow3 is determined from the battery charging amount. When the battery charging amount becomes less than a predetermined value (SOC2 in FIG. 4B), Pow3 is reduced to zero, and the third pump target flow rate computed later is reduced to zero, so that, when the battery charging amount becomes less than the predetermined amount, the electric motor M driving the third pump P3 is not operated.

The computation of the reference flow rate of each pump of FIG. 5 will be described. Referring to table T1, Qa1 is determined from the maximum operation pressure PLm1 (which, in this case, is the bucket operation pilot pressure) of the actuators connected to the first pump P1. Further, referring to table T2, Qa2 is determined from the maximum operation pressure PLm2 (which, in this case, is the maximum value of the arm operation pilot pressure and the swing operation pilot pressure) of the actuators connected to the second pump P2. Through the flow rate computation C1, Q12*b* is determined from the first and second pump delivery pressures Sv1 and Sv2 and the first/second pump reference power Pow12, and the minimum value of Q1*a* and Q12*b* is used as the first pump reference flow rate Q1*c*, and the minimum value of Q2*a* and Q12*b* is used as the second pump reference flow rate Q2*c*.

Further, referring to table T3, the reference flow rate Qa3 is determined from the maximum operation pressure PLm3 (which, in this case, is the arm operation pilot pressure) of the actuators connected to the third pump P3. Through the flow rate computation C2, the reference flow rate Q3*b* is determined from the third pump delivery pressures Sv3 and the third pump reference power Pow3, and the minimum value of the reference flow rates Q3*a* and Q3*b* is used as the third pump reference flow rate Q3*c*. It is noted here that assuming that the swing/arm combined operation is performed and that the arm load pressure is of light load (Pam1 or less in FIG. 6), the third pump target flow rate Q3*d* is Q3*c*, and the second pump target flow rate Q2*d* is what is obtained by subtracting Q3*c* from the second pump reference flow rate Q2*c*. The first pump target flow rate is not corrected, and Q1*d* is Q1*c*.

Based on the pump target flow rates calculated as described above, the tilting angle of the first and second pumps P1 and P2 and the motor speed of the electric motor M driving the third pump P3 are controlled.

The pilot pressures PL1 and PL2 outputted from the arm operation device 19 are respectively guided to the left pilot pressure receiving portions of the directional control valves V1 and V4 and to the right pilot pressure receiving portions of the directional control valves V1 and V4, switch-operating the directional control valves V1 and V4 to the left or right. The pilot pressures PL3 and PL4 outputted from the bucket operation device 20 are respectively guided to the left pilot pressure receiving portion and to the right pilot pressure receiving portion of the directional control valve V2, switch-operating the directional control valve V2 to the left or right. The pilot pressures PL5 and PL6 outputted from the swing operation device 21 are respectively guided to the left pilot pressure receiving portion and to the right pilot pressure receiving portion of the directional control valve V3, switch-operating the directional control valve V3 to the left or right.

As a result, the hydraulic fluid is supplied from the third pump P3 to the arm cylinder 8 in accordance with the operation of the arm operation lever 19*b*, the hydraulic fluid is supplied from the first pump P1 to the bucket cylinder 9 in accordance with the operation of the bucket operation lever 20*b*, the hydraulic fluid is supplied from the second pump P2 to the swing hydraulic motor 10 in accordance with the operation of the swing operation lever 21*b*, and an arm/bucket/swing combined operation in a light load work is realized. At this time, the second pump hydraulic line L2 communicates with both the arm cylinder 8 and the swing hydraulic motor 10 via the directional control valves V1 and V2. However, the directional control valve V1 is provided on the downstream side in a tandem connection with respect to the directional control valve V3, and a restrictor is provided in the parallel hydraulic line L4, so that the delivered hydraulic fluid from the second pump P2 is scarcely supplied to the arm cylinder 8. Thus, almost no pressure loss is generated in the control restrictor dividing the delivered hydraulic fluid from the second pump P2 to the arm cylinder 8.

(Arm/Bucket/Swing Combined Operation (Heavy Load))

When the arm operation lever 19*b*, the bucket operation lever 20*b*, and the swing operation lever 21*b* are simultaneously operated, the pilot pressures PL1 through PL6 are outputted from the pilot valves 19*a* through 21*a* in accordance with the operation of each operation lever.

The controller 18 controls the delivery flow rates of the first through third pumps P1 through P3 based on the control flow of FIG. 3. It is noted here that when the arm load pressure reaches a predetermined value or more (Pam2 or more in FIG. 6), the correction gain G of the third pump is reduced to zero, and the corrected third pump reference flow rate is reduced to zero. As a result, the third pump target flow rate is reduced to zero, and the second pump target flow rate coincides with the second pump reference flow rate.

The pilot pressures PL1 and PL2 outputted from the arm operation device 19 are respectively guided to the left pilot pressure receiving portions of the directional control valves V1 and V4 and to the right pilot pressure receiving portions of the directional control valves V1 and V4, switch-operating the directional control valves V1 and V4 to the left or right side. The pilot pressures PL3 and PL4 outputted from the bucket operation device 20 are respectively guided to the left pilot pressure receiving portion and to the right pilot pressure receiving portion of the directional control valve V2, switch-operating the directional control valve V2 to the left or right side. The pilot pressures PL5 and PL6 outputted from the swing operation device 21 are respectively guided to the left pilot pressure receiving portion and to the right pilot pressure receiving portion of the directional control valve V3, switch-operating the directional control valve V3 to the left or right side.

As a result, the delivered hydraulic fluid from the second pump P2 is divided and supplied to the arm cylinder 8 and the swing hydraulic motor 10 in accordance with the operation of the arm operation lever 19*b* and the swing operation lever 21*b*, and the delivered hydraulic fluid from the first pump P1 is supplied to the bucket cylinder 9 in accordance with the operation of the bucket operation lever 20*b*, thus realizing the arm/bucket/swing combined operation in a heavy load work. At this time, the electric motor M is not operated, so that no hydraulic fluid is supplied from the third pump P3 to the arm cylinder 8.

In the hydraulic drive system according to the present embodiment, FIG. 9 is a diagram illustrating the relationship between drive modes M1 through M8 determined by a combination of the arm load pressure (light-load/heavy-load), the arm operation (single/combined), and the arm drive source (second pump P2/third pump P3), and the energy loss (drag loss, pressure loss, and electric power loss) generated in each drive mode.

(Drive Modes M1 and M2)

In a light load work using the arm alone, when the arm cylinder 8 is driven by the engine-driven second pump P2 (drive mode M1), the drag loss accompanying the driving of the third pump P3 and the electric power loss accompanying the operation of the electric motor M are not generated. Further, the delivered hydraulic fluid from the second pump P2 is only supplied to the arm cylinder 8, so that the pressure loss accompanying the flow division is not generated. On the other hand, when the arm cylinder 8 is driven by the electric-motor-driven third pump P3 (drive mode M2), the pressure loss accompanying the flow division is not generated as in the drive mode M1. However, the drag loss accompanying the driving of the third pump P3 and the electric power loss accompanying the operation of the electric motor M are generated. Thus, in a light load work in which the arm is used singly, the energy loss is smaller (the fuel efficiency is better) when the arm cylinder 8 is driven by the engine-driven second pump P2 (drive mode M5 is selected).

(Drive Modes M3 and M4)

In a swing/arm combined light load work, when the arm cylinder 8 and the swing hydraulic motor 10 are driven by the engine-driven second pump P2 (drive mode M3), the drag loss accompanying the driving of the third pump P3 and the electric power loss accompanying the operation of the electric motor M are not generated. However, the second pump P2 communicates with the arm cylinder 8 and the swing hydraulic motor 10, and a large amount of hydraulic fluid is divided and supplied from the second pump P2 to the arm cylinder 8 of low load pressure, so that a large pressure loss is generated. On the other hand, when the swing hydraulic motor 10 is driven by the second pump P2, and the arm cylinder 8 is driven by the third pump P3 (drive mode M4), the drag loss accompanying the driving of the third pump P3 and the electric power loss accompanying the operation of the electric motor M are generated. However, since the arm load pressure is low and the consumption power of the electric motor M is small, the electric power loss is small. Further, the delivered hydraulic fluid from the second pump P2 is only supplied to the swing hydraulic motor 10, so that the pressure loss accompanying the flow division is not generated. Thus, in a swing/arm combined light load work, the energy loss is smaller (the fuel efficiency is better) when the arm cylinder 8 is driven by the electric-motor-driven third pump P3 (drive mode M4 is selected).

(Drive Modes M5 and M6)

In a heavy load work using the arm singly, when the arm cylinder 8 is driven by the engine-driven second pump P2 (drive mode M5), the drag loss accompanying the driving of the third pump P3 and the electric power loss accompanying the operation of the electric motor M are not generated. Further, the delivered hydraulic fluid from the second pump P2 is only supplied to the arm cylinder 8, so that the pressure loss accompanying the flow division is not generated. On the other hand, when the arm cylinder 8 is driven by the electric-motor-driven third pump P3 (drive mode M6), the drag loss accompanying the driving of the third pump P3 and the electric power loss accompanying the operation of the electric motor M are generated. However, the load pressure in the arm cylinder 8 is low and the consumption electric power of the electric motor M is small, so that the electric power loss is small. Thus, in a heavy load work in which only the arm is used, the energy loss is smaller (the fuel efficiency is better) when the arm cylinder 8 is driven by the engine-driven second pump P2 (drive mode M5 is selected).

(Drive Modes M7 and M8)

In a swing/arm combined heavy load work, when the arm cylinder 8 and the swing hydraulic motor 10 are simultaneously driven by the engine-driven second pump P2 (drive mode M7), the drag loss accompanying the driving of the third pump P3 and the electric power loss accompanying the operation of the electric motor M are not generated. At this time, the second pump P2 communicates with the arm cylinder 8 and the swing hydraulic motor 10. However, the arm load pressure is high and the amount of hydraulic fluid divided and supplied to the arm cylinder 8 from the second pump P2 is small, so that no great pressure loss is generated. On the other hand, when the swing hydraulic motor 10 is driven by the second pump P2, and the arm cylinder 8 is driven by the third pump P3 (drive mode M8), the delivered hydraulic fluid from the second pump P2 is only supplied to the swing hydraulic motor 10, so that the pressure loss accompanying the flow division is not generated. However, the drag loss accompanying the driving of the third pump P3 is generated, and due to the driving of the arm cylinder 8 of high load pressure by the electric-motor-driven third pump P3, the consumption electric power of the electric motor M increases, and a large electric power loss is generated. Thus, in a swing/arm combined heavy load work, the energy loss is smaller (the fuel efficiency is better) when the arm cylinder 8 is driven by the engine-driven second pump P2 (drive mode M7 is selected).

In the hydraulic drive system according to the present embodiment, the controller 18 executes the control flow shown in FIG. 3, whereby one of the drive modes M1, M4, M5, and M7, which are of small energy loss (of satisfactory fuel efficiency), is selected in correspondence with the arm operation, the swing operation, and the arm load pressure.

—Advantage—

According to the embodiment of the present invention described above, at the time of the single operation in which only the arm cylinder 8 of the plurality of actuators 8 and 10 connected to the second pump hydraulic line L2 is operated, the electric motor M is not operated, and the arm cylinder 8 is driven by the second pump P2, whereby it is possible to suppress the generation of the drag loss accompanying the driving of the third hydraulic pump P3. On the other hand, at the time of the combined operation in which the plurality of actuators 8 and 10 including the arm cylinder 8 connected to the second pump hydraulic line L2 are simultaneously operated, the electric motor M is operated, and the arm cylinder 8 is driven by the third pump P3, whereby it is possible to suppress the pressure loss which is generated when the delivered hydraulic fluid from the second pump P2 is divided and supplied to the arm cylinder 8. In this way, the arm cylinder 8 is selectively driven by the engine-driven second pump P2 and the electric-motor-driven third pump P3 in accordance with the arm operation and the swing operation, and the pressure loss accompanying the flow division and the drag loss accompanying the driving of the third pump P3 are suppressed, whereby it is possible to improve the fuel efficiency of the work machine. The arm cylinder 8, which frequently undergoes combined operation in light load work and which requires a high flow rate, is used as the specific actuator that can be selectively driven by the second pump P2 and the third pump P3, whereby it is possible to enhance the effect of suppressing the pressure loss and the drag loss as compared with the case where some other actuator is used as the specific actuator.

Further, in the embodiment of the present invention described above, the electric motor M is not operated in a heavy load work (in which the load pressure of the arm cylinder 8 is Pam2 or more), and the arm cylinder 8 is driven by the second pump P2, whereby it is possible to prevent an excessive increase in the electric power consumption of the electric motor M, and to prevent an increase in the electric power loss accompanying the operation of the electric motor M.

Further, in the embodiment of the present invention described above, the electric motor M is not operated when abnormality is generated in the electric system related to the driving of the third pump P3, and the delivered hydraulic fluid from the engine-driven second pump P2 is divided and supplied to the arm cylinder 8 and the swing hydraulic motor 10, whereby it is possible to prevent serious failure related to the electric system, and to maintain an operability equivalent to that in the prior art. Further, also in the case where the residual amount of the battery 14 is insufficient, the electric motor M is not operated, and the delivered hydraulic fluid from the engine-driven second pump P2 is divided and supplied to the arm cylinder 8 and the swing hydraulic motor 10, whereby it is possible to maintain an operability equivalent to that in the prior art.

DESCRIPTION OF REFERENCE CHARACTERS

1: Lower track structure
2: Upper swing structure
2*a*: Swing frame
3: Front work device
4: Boom
5: Arm
6: Bucket
7: Boom cylinder
8: Arm cylinder (second actuator/specific actuator)
9: Bucket cylinder (first actuator)
10: Swing hydraulic motor (second actuator)
11*a*, 11*b*: Crawler
12*a*, 12*b*: Traveling hydraulic motor
13: Engine
14: Battery
15: Control valve
17: Pilot hydraulic fluid source
18: Main controller (control device)
19: Arm operation device
20: Bucket operation device
21: Swing operation device
19*a* through 21*a*: Pilot valves
19*b*: Arm operation lever
20*b*: Bucket operation lever
21*b*: Swing operation lever
22: Battery controller (charging rate detection device)
23: First inverter controller
24: Second inverter controller
25: Generator motor thermistor
26: Electric motor thermistor
30: Electric system
GM: Generator motor
INV1: First inverter
INV2: Second inverter
L1: First pump hydraulic line
L2: Second pump hydraulic line
L3: Third pump hydraulic line
L4: Parallel hydraulic line
L5: Head side hydraulic line
L6: Rod side hydraulic line
M: Electric motor
M1 through M8: Drive modes
P1: First pump
P2: Second pump
P3: Third pump
PL1 through PL6: Pilot pressures
R1: First pump regulator
R2: Second pump regulator
S1 through S3: Pump pressure sensors
S4, S5: Load pressure sensor (load pressure detection device)
S6 through S11: Pilot pressure sensors (operation amount detection devices)
T1, T2: Conversion table
V1: Directional control valve (second directional control valve)
V2: Directional control valve (first directional control valve)
V3: Directional control valve (second directional control valve)
V4: Directional control valve (third directional control valve)

The invention claimed is:

1. A hydraulic drive system of a work machine comprising:

an engine;

first and second hydraulic pumps driven by the engine;

first and second pump hydraulic lines to which a delivered hydraulic fluid from the respective first and second hydraulic pumps is supplied;

at least one first actuator driven by the hydraulic fluid supplied from the first pump hydraulic line;

a plurality of second actuators driven by the hydraulic fluid supplied from the second pump hydraulic line;

a first directional control valve provided in the first pump hydraulic line and controlling a flow rate of the hydraulic fluid supplied to the first actuator;

a plurality of second directional control valves provided in the second pump hydraulic line and each controlling the flow rate of the hydraulic fluid supplied to the plurality of second actuators;

a plurality of operation devices operating the first actuator and the plurality of second actuators by respectively switch-operating the first directional control valve and the plurality of second directional control valves;

an electric motor;

a third hydraulic pump driven by the electric motor;

a third pump hydraulic line to which a delivered hydraulic fluid from the third hydraulic pump is supplied;

a third directional control valve provided in the third pump hydraulic line, switch-operated by a specific operation device of the plurality of operation devices that operates a specific actuator of the plurality of second actuators, and controlling the flow rate of the hydraulic fluid supplied to the specific actuator from the third hydraulic pump;

a plurality of operation amount detection sensors detecting operation amounts of the plurality of operation devices; and a control device that is configured to control the electric motor in accordance with operation amounts of the plurality of operation devices corresponding to the plurality of second actuators out of the operation amounts detected by the plurality of operation amount detection sensors, wherein the control device is further configured to control the third directional control valve such that the third hydraulic pump supplies the hydraulic fluid to the specific actuator, with a hydraulic line that supplies the hydraulic fluid from the second hydraulic pump to the specific actuator being restricted, when a combined operation of two or more second actuators including the specific actuator out of the plurality of second actuators is detected by the plurality of operation amount detection sensors.

2. The hydraulic drive system of a work machine according to claim 1, further comprising a load pressure detection sensor detecting a load pressure in the specific actuator, wherein the control device does not drive the third hydraulic pump by the electric motor when a combined operation of two or more second actuators including the specific actuator out of the plurality of second actuators is detected by the plurality of operation amount detection sensors, and the load pressure of the specific actuator detected by the load pressure detection sensor is higher than a predetermined load pressure.

3. The hydraulic drive system of a work machine according to claim 1, wherein the specific actuator is an arm cylinder.

4. The hydraulic drive system of a work machine according to claim 1, further comprising an abnormality detection device detecting abnormality in an electric system including the electric motor, wherein the control device does not drive the third hydraulic pump by the electric motor when abnormality in the electric system is detected by the abnormality detection device.

5. The hydraulic drive system of a work machine according to claim 1, further comprising: a battery accumulating electric power for driving the electric motor, and a charging rate detection device detecting a charging rate of the battery, wherein the control device does not drive the third hydraulic pump by the electric motor when the battery charging rate detected by the charging rate detection device is lower than a predetermined charging rate.

* * * * *